US005632686A

United States Patent [19]

Checketts

[11] Patent Number: 5,632,686

[45] Date of Patent: May 27, 1997

[54] PNEUMATIC DEVICE FOR ACCELERATING AND DECELERATING OBJECTS

[76] Inventor: Stanley J. Checketts, P.O. Box 55, Providence, Utah 84332

[21] Appl. No.: 324,759

[22] Filed: Oct. 17, 1994

[51] Int. Cl.[6] ..... A63G 31/10

[52] U.S. Cl. ..... 472/131; 472/50; 472/134

[58] Field of Search ..... 472/131, 135, 472/136, 137, 134, 50; 482/69

[56] References Cited

U.S. PATENT DOCUMENTS

| | | | |
|---|---|---|---|
| 4,997,060 | 3/1991 | Sassak | 472/131 X |
| 5,087,037 | 2/1992 | Morrow | 472/134 X |
| 5,417,615 | 5/1995 | Beard | 472/50 |
| 5,447,211 | 9/1995 | Sors | 472/131 X |

*Primary Examiner*—Kien T. Nguyen
*Attorney, Agent, or Firm*—Thompson E. Fehr

[57] ABSTRACT

A pneumatic device for accelerating and decelerating one or more objects by introducing compressed gas through an injection valve into the bore of a housing. A piston is slidably mounted in the bore and has a cable attached to one side. The cable travels through an aperture near one end of the housing before passing over a first pulley and then connecting to a carrier which hold the object or objects. The cable is selected to be of a length such that the piston will not exit the open end of the bore, which is opposite to the end near where the aperture is located. This creates the possibility of operating the pneumatic device in two different modes. In the first mode, the pressure of the introduced gas is insufficient to propel the objects past the side of the first pulley that is opposite to the initial location of the objects. The force of the introduced gas accelerates the piston away from the end of the bore near the aperture, subsequently decelerates the piston after it has changed direction, and then begins the cycle again. When a greater pressure is utilized, the gas will accelerate the piston and the objects until they pass the first pulley; then decelerate the objects until they stop beyond the first pulley; subsequently accelerate the objects toward the first pulley, creating a perceived negative gravitational force if the movement is vertical; and then decelerate the objects after they have again passed the first pulley.

26 Claims, 9 Drawing Sheets

PNEUMATIC DEVICE FOR ACCELERATING AND DECELERATING OBJECTS

BACKGROUND OF THE INVENTION

1. Field of the Invention

This invention relates to a device and method for pneumatically accelerating and decelerating an object, especially a participant on an amusement device commonly termed an amusement ride.

2. Description of the Related Art

In the sport of bungee jumping a participant usually ascends a tower, walks onto a bridge, is hoisted in a basket by a tower crane, or is lifted aloft in the gondola of a hot air balloon with a resilient band, i.e., a bungee cord, attached to the participant's body and to the tower, bridge, basket, or gondola. The participant then leaps from the tower, bridge, basket, or gondola and, because of the interactions between the force of gravity and the elastic force of the band, undergoes a series of basically vertical oscillations. Dampening produced by air friction and losses of energy within the band causes the oscillations to cease within a relatively short period of time. The participant is then lowered to the earth.

An initial device to capture the freedom and exhilaration of bungee jumping with increased safety and rapidity of repeating the experience is described in U.S. Pat. No. 5,203,744 of Stanley J. Checketts. The device consists basically of a tower which participants may ascend by using a stairway or escalator, arms branching from the tower having open ends from which a participant attached to a resilient band may leap, and a winch to lower the participant to the earth after the oscillations induced by the initial leap have subsided and to restore the resilient band to its original location after it has been detached from the participant. The speed with which this experience may be repeated is, however, limited by two factors—the time it takes the participant to ascend the tower and the inability of each resilient band to handle more than one participant at a time.

Theoretically, more than one participant could simultaneously be elevated and then oscillated on the amusement device discussed in U.S. Pat. No. 2,221,215 of Lee U. Eyerly. But the practical capacity of Eyerly's car is severely limited by the fact that the springs or rubber bands essential to producing the oscillations are connected directly to a rigid member that pushes the bottom of the car and must, therefore, be vertically mounted. To generate sufficient force for vertically accelerating a platform capable of carrying more than a few participants requires large and, consequently, heavy springs or resilient bands. When installed vertically, their own weight impairs the resiliency of these springs or bands.

Another device which can produce vertical oscillations of multiple participants is the subject of U.S. Pat. No. 1,991,459, which was issued to Rudolf Heimers. Such device simply utilizes the muscular power of the participants to raise or lower a carrier that is suspended from a rope which winds around a flywheel that has an eccentrically arranged weight. The initial movement will cause the flywheel cyclically to wind and unwind the rope, thereby oscillating the participants. Since these oscillations are produced by the muscular power of the participants, the oscillations will require a rather lengthy period to reach reasonable amplitudes; and the attendant acceleration and deceleration will be rather limited in magnitude.

A final amusement device related to the present invention is described in U.S. Pat. No. 3,701,528 of Jerry E. Ryan.

This device consists of a vertical tower having eight outwardly extending horizontal arms. A participant can be suspended with a cable from a pulley attached to one of the horizontal arms. The participant is raised by filling a bucket attached to the other end of the cable with an adequate supply of water to act as a counterweight. Raising a removable weight from the bucket causes the participant slightly to outweigh the bucket of water then forming the counterweight so that the participant experiences a perceived reduced positive gravitational force. The device of U.S. Pat. No. 3,701,528 cannot, however, create a perceived negative (upward) gravitational force. Its operation, furthermore, requires a considerable period of time since each horizontal arm cannot simultaneously handle more than one participant and since the required movement of water will be quite consumptive of time.

All four of the preceding inventions are, moreover, limited to functioning in a basically vertical direction.

Additionally, no amusement device related to the present invention appears to be pneumatically operated. U.S. Pat. No. 3,587,397 of Berge Hagopian does, however, apply to a single pneumatic cylinder within which gas pressure applied to one face of a piston accelerates the piston for a portion of a stroke, whereupon the piston reaches an area in which a portion of the bore of the cylinder is enlarged to permit gas to pass around the piston to equalize the pressure on both sides of the piston. Momentum of the piston then carries it into a region where the bore has its original dimensions. Compression of the gas in front of the moving piston next decelerates the piston. Rebounding of the piston is prevented by allowing gas to pass, at a controlled rate, through an orifice leading from the substantially closed end of the cylinder toward which the piston has been accelerated.

No suggestion exists, though, that the device of U.S. Pat. No. 3,587,397 could be utilized in an amusement ride; and, as observed above, this device is designed to preclude the piston from rebounding.

SUMMARY OF THE INVENTION

The present invention utilizes the pressure of compressed gas introduced into the bore of a housing, which—except for the injection valve used to introduce the gas and an aperture through which a cable passes—is closed at the end where the gas is introduced, in order to create sufficient force to rapidly accelerate a piston that can travel freely along the length of the bore and thereby rapidly accelerate one or multiple participants who are attached to the piston by the cable—and, preferably, also by a carrier, such as a seat or a harness.

Although the end of the housing opposite to the end containing the aperture could be closed, it is preferably left open to the atmosphere. Confining the gas at this end of the bore would necessitate injecting gas with a higher initial pressure at the other end to have the piston reach the same distance from the aperture.

Unlike a solid spring, the weight of the compressed air does not impede the resiliency of such air; so, the bore can be placed in any orientation.

Similarly, the participant or participants may be moved in any direction relative to the earth and also in any direction relative to the bore. Therefore, to assist in orienting the cable and often to reduce frictional forces, the cable-after exiting the aperture and before reaching any participant-preferably passes around a first guide pulley or other friction-reducing device that can alter the direction of the cable, such as a bearing. (A guide pulley is one which at some time during the operation of the Pneumatic Device has no other pulley between it and the participant or participants.)

If the first guide pulley is not located at some point beyond the end of the housing which contains the aperture, a pulley (or bearing or the like) designated an auxiliary pulley is preferably so located to reduce frictional forces.

The length of the cable is selected such that when the participant reaches the side of the first guide pulley that is opposite to the initial position of the participant, the piston will not have reached the end of the bore opposite to the end with the aperture. This creates the possibility of operating the Pneumatic Device in two different modes.

For the first mode, the initial pressure of the compressed gas introduced into the bore is selected to be such that the piston will be propelled only so far that the participants will then never pass the first guide pulley.

The movement of the piston is also simpler in this first mode. When a compressed gas is introduced into the bore, such compressed gas will accelerate the piston toward the end of the bore opposite the aperture. This will continue until the reduction in pressure within the bore, because of the increased volume created by the piston moving away from the aperture, lowers the force pushing the piston away from the aperture so that such force is equal to forces acting on the piston in the opposite direction. Momentum will, however, continue to move the piston some additional distance from the aperture.

As momentum carries the piston beyond the point where the forces acting in both directions on the piston are equal, the pressure on the side toward the aperture will produce a force acting away from the aperture that lags continually farther behind the forces acting on the piston in the opposite direction until this imbalance of forces overcomes the momentum, stops the movement of the piston, and begins to force the piston toward the aperture. Momentum will again propel the piston past the point where the opposing forces equalize and will, therefore, compress the gas on the side of the piston with the aperture. The process then repeats itself, oscillating the participant or participants connected to the piston with the cable.

Energy losses are caused by friction as well as gas escaping through the small space between the cable and the edge of the aperture. (If losses of the gas are desired to be decreased, the cable could be coated with a substance to create a smooth surface, such as nylon.)

Because of the losses of energy, the amplitude of each subsequent oscillation decreases.

When it is desired to cease or reduce the oscillations, a control valve connected to the end of the housing with the aperture may be opened to release the gas at a controlled rate. Alternatively, if the space between the cable and the edge of the aperture is sufficiently large, the loss of gas through such space will terminate the oscillations within a reasonable period of time.

Conversely, if it is desired to maintain or increase the amplitude of the oscillations, additional compressed gas can be introduced into the bore when the piston is near the aperture.

If one desires oscillations in this first mode, rather than just the initial acceleration and deceleration, it is preferable to have the initial position of the participant such a distance lower than the position of the participant when the piston has reached its maximum distance from the aperture that there will be an adequate component of force acting on the end of the cable attached to the participant to keep the cable from going slack as the piston is pushed toward the aperture.

In the second mode, the initial pressure of the compressed gas introduced into the bore is sufficiently greater than the initial pressure associated with the first mode that the participants will be propelled past the first guide pulley. Since the mass of the piston is selected such that the mass of the participants (or of the participants and the carrier) exceeds that of the piston, the momentum of the participants (or of the participants and the carrier) will exceed that of the piston as the piston moves away from the aperture because the connecting cable assures that the speed of all the entities is equal. Thus, with the length of the cable being as stated above and with the participants still moving when the participants reach the side of the first guide pulley that was opposite to their initial position, because of the Law of Conservation of Momentum, the participants will continue traveling in the same direction at a slightly reduced speed; and the piston will reverse directions and move toward the aperture at this same speed.

As the piston proceeds toward the aperture, the piston will compress the introduced gas even more than in the first mode because the momentum of the participants is pushing the piston toward the aperture. The force created by the compressed gas will, as in the first mode, decelerate and eventually stop the piston and the participant. Again, the pressure of the gas will be reduced below its original level because of energy losses and, if the movement of the participants has a vertical component, because of the force of gravity, which would, however, also aid the downward acceleration of the participants. But, as in the case of the first mode, the amplitude of the oscillations could be maintained or increased by introducing additional compressed gas into the bore when the piston is near the aperture.

Now as the compressed gas accelerates the piston away from the aperture, it also accelerates the participants toward their initial position. If the initial movement of the passengers was upward, this acceleration will be downward, causing the reactive force to such acceleration to create for the participants not only a reduced perceived gravitational force but a perceived negative gravitational force—an experience that none of the devices in the prior art patents cited above can create.

As the participants reach the first guide pulley, the piston will again move toward the aperture, compress the introduced gas, and decelerate the participants. When compression of the gas is sufficient to stop the piston, the piston will again be forced away from the aperture, moving the participants in their initial direction and starting the cycle once more.

As with the first mode, the control valve may be used to release compressed gas and terminate the cycle, although a sufficient space between the cable and the edge of the aperture would, as explained above, render this unnecessary, as also would the placement of an orifice near the aperture.

For practical convenience in orienting the cable after the participants pass the first guide pulley and in reducing frictional forces, a second guide pulley is aligned with the first guide pulley and placed on the side of the first guide pulley opposite to the initial location of the participants.

DESCRIPTION OF THE PREFERRED EMBODIMENT

Figure 1:
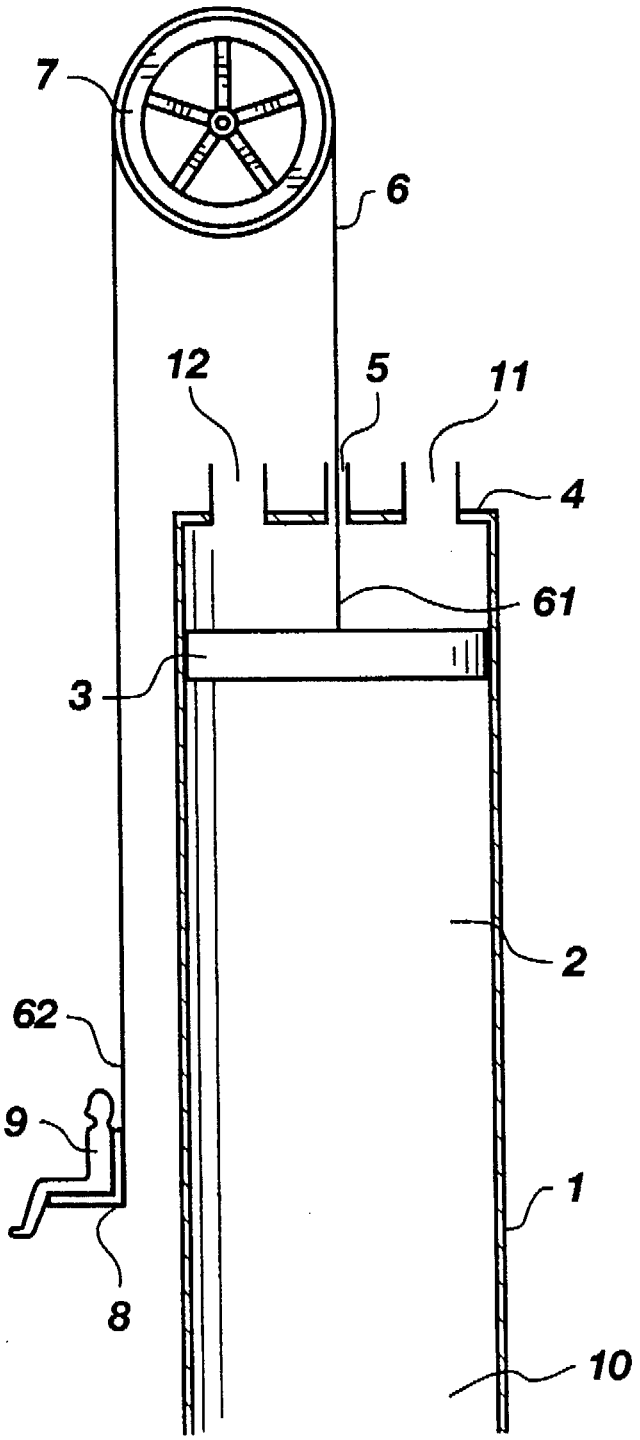
FIG. 1 depicts an embodiment of the Pneumatic Device for Accelerating and Decelerating Objects that employs a single guide pulley.

As illustrated in FIG. 1, the preferred embodiment of the Pneumatic Device for Accelerating and Decelerating Objects has a housing (1) containing a bore (2). A piston (3) is slidably mounted within the bore (2) and can travel freely along the length of said bore (2).

The first end (4) of the housing (1) preferably possesses an aperture (5) through which a cable (6) passes; at least the aperture (5) is nearer said first end (4) than the piston (3) ever will be. A first end (61) of the cable (6) is attached to the piston (3). After leaving the housing (1), the cable (6) passes around a first guide pulley (7) before the second end (62) of the cable is connected to the carrier (8) for one or more participants (9).

The second end (10) of the housing (1) could be closed but, as explained above, is preferably left open.

When it is desired rapidly to accelerate a participant (9), compressed gas is introduced into the bore (2) through an injection valve (11) that is preferably located in the first end (4) of the housing (1) but, in any event, is nearer to said first end (4) than the piston (3) will ever be. The piston (3) will then rapidly be accelerated away from the first end (4) of the housing (1), thereby accelerating the participant (9) toward the first guide pulley (7).

Subsequent motion of the piston (3) and the participant (9) will then occur just as described in the Summary of the Invention.

When it is desired to terminate or reduce the oscillations, compressed gas is released at a controlled rate through a control valve (12) connected to the housing (1) and preferably located oil the first end (4) of the housing (1). This could be done after one or more oscillations of the participant (9) or even just after the initial acceleration and deceleration.

The preferred movement of the participant (9) is vertical; but, as noted above, it could be in any direction. As also mentioned above, however, it should be remembered that if one desires oscillations with this embodiment, rather than just the initial acceleration and deceleration, it is preferable to have the initial position of the participant (9) such a distance lower than the position of the participant (9) when the piston (3) has reached its maximum distance from the first end (4) of the housing (1) that there will be an adequate component of force acting on the second end of the cable (6), which is attached to the participant (9) by the carrier (8), to keep the cable (6) from going slack as the piston (3) is pushed toward the first end (4) of the housing (1).

For the embodiment of FIG. 1, the initial pressure of the compressed gas introduced into the bore (2) is preferably selected to be such that the piston (3) will be propelled only some distance less than the length of the bore (2). Also, for all embodiments the length of the cable (6) is selected such that when the participant (9) reaches the side of the first guide pulley (7) that is opposite to the initial position of the participant (9), the piston (3) will not have reached the second end (10) of the housing (1).

Figure 2:
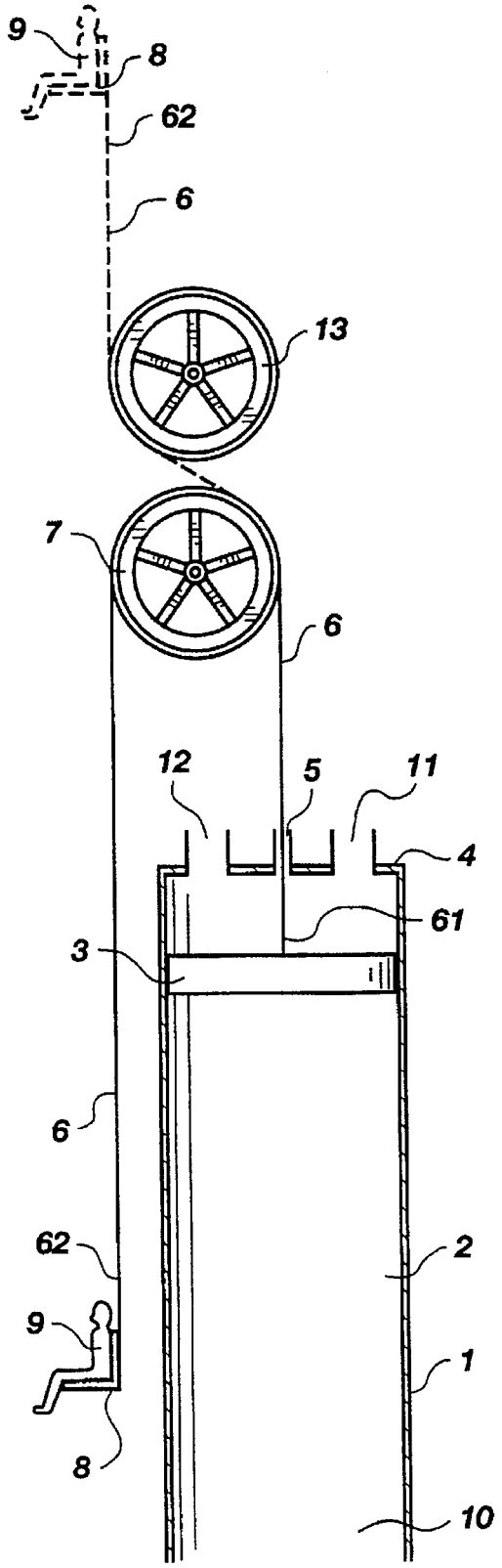
FIG. 2 portrays an alternate embodiment which utilizes two guide pulleys.

An optional embodiment is shown in FIG. 2. Again the orientation of the optional embodiment and direction of travel for the participant (9) are shown to be vertical, but they could be any direction.

Figure 8:
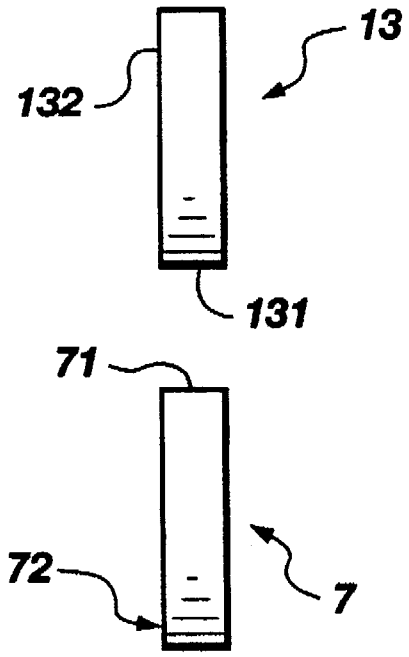
FIG. 8 depicts the orientation of the first guide pulley with respect to the second guide pulley from the perspective of one facing the rims of the first guide pulley and the second guide pulley.
Figure 9:
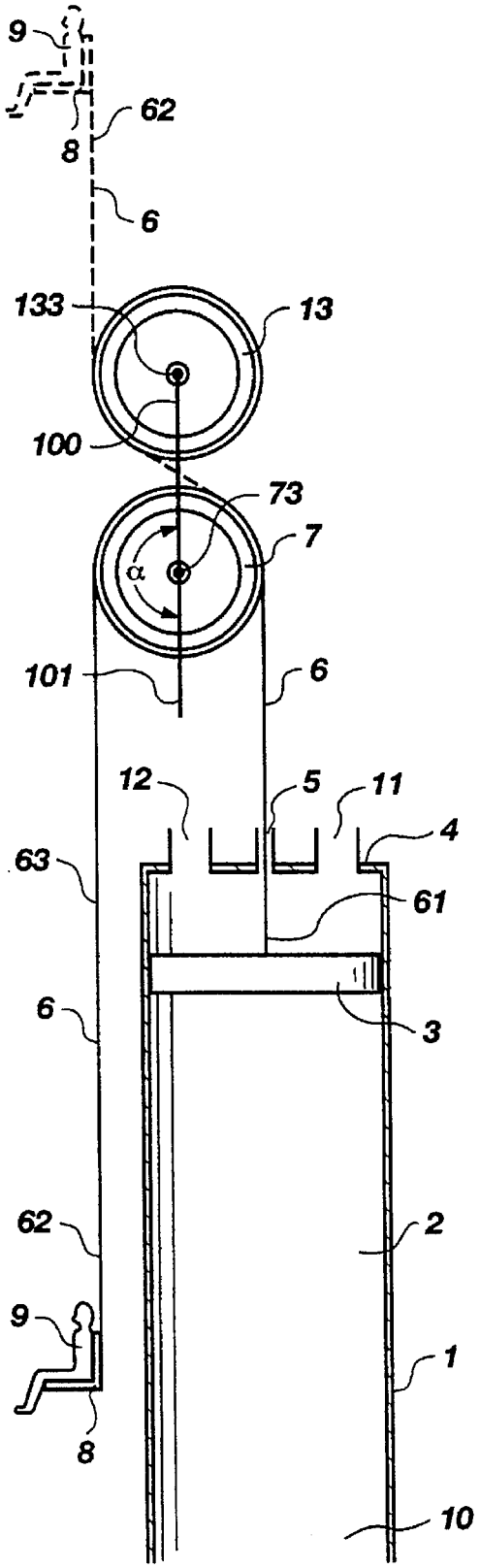
FIG. 9 depicts the orientation of the first guide pulley with respect to the second guide pulley from the perspective of one facing the edges of the first guide pulley and the second guide pulley.

The structure of the optional embodiment depicted in FIG. 2 differs from the structure of the embodiment portrayed in FIG. 1 merely by the addition of a second guide pulley (13). As illustrated with greater detail in FIG. 8, the second guide pulley (13) is aligned with the first guide pulley (7) in that the rim (131) of the second guide pulley (13) faces the rim (71) of the first guide pulley; and the first edge (132) of the second guide pulley (13) is approximately in the same plane as the first edge (72) of the first guide pulley (7). Furthermore, as depicted in FIG. 9, the second guide pulley (13) is placed on the side of the first guide pulley (7) opposite to the initial location of the participant, i.e., the second guide pulley (13) is so oriented with respect to the first guide pulley (7) that the angle ($\alpha$) between an imaginary line (100) running from the axle (133) of the second guide pulley (13) to the axle (73) of the first guide pulley (7) and an imaginary line (101) running from the axle (73) of the first guide pulley (7) toward the initial position of the participant (9) and concurrently running parallel to the portion (63) of the cable (6) between the first guide pulley (7) and the initial position of the participant (9) is at least 90 degrees but no more than 270 degrees and is preferably 180 degrees.

The optional embodiment of FIG. 2 can function exactly as does the embodiment of FIG. 1. However, the optional embodiment of FIG. 2 orients the cable (6) when the initial pressure of the compressed gas introduced into the bore (2) is sufficient that the participant (9) and the piston (3) are still moving when the participant (9) reaches the side of the first guide pulley (7) that was opposite to the initial position of the participant (9); and the second mode of operation for the Pneumatic Device, which was explained above in the Summary of the Invention, is, therefore, experienced.

As the participant (9) moves past the first guide pulley (7) toward the second guide pulley (13), the cable (6) will simply leave the first guide pulley (7) and engage the second guide pulley (13) as shown by the dotted lines in FIG. 2. When the participant (9) moves in the opposite direction past the second guide pulley (13), i.e., toward the first guide pulley (7), the cable (6) will leave the second guide pulley (13) and engage the first guide pulley (7).

If the first guide pulley (7) and the second guide pulley (13) were oriented in a horizontal direction with respect to one another and the movement of the participant (9) were in a horizontal direction, release of the compressed gas after the initial acceleration and deceleration would accurately simulate the movement of a drag racer.

Figure 3:
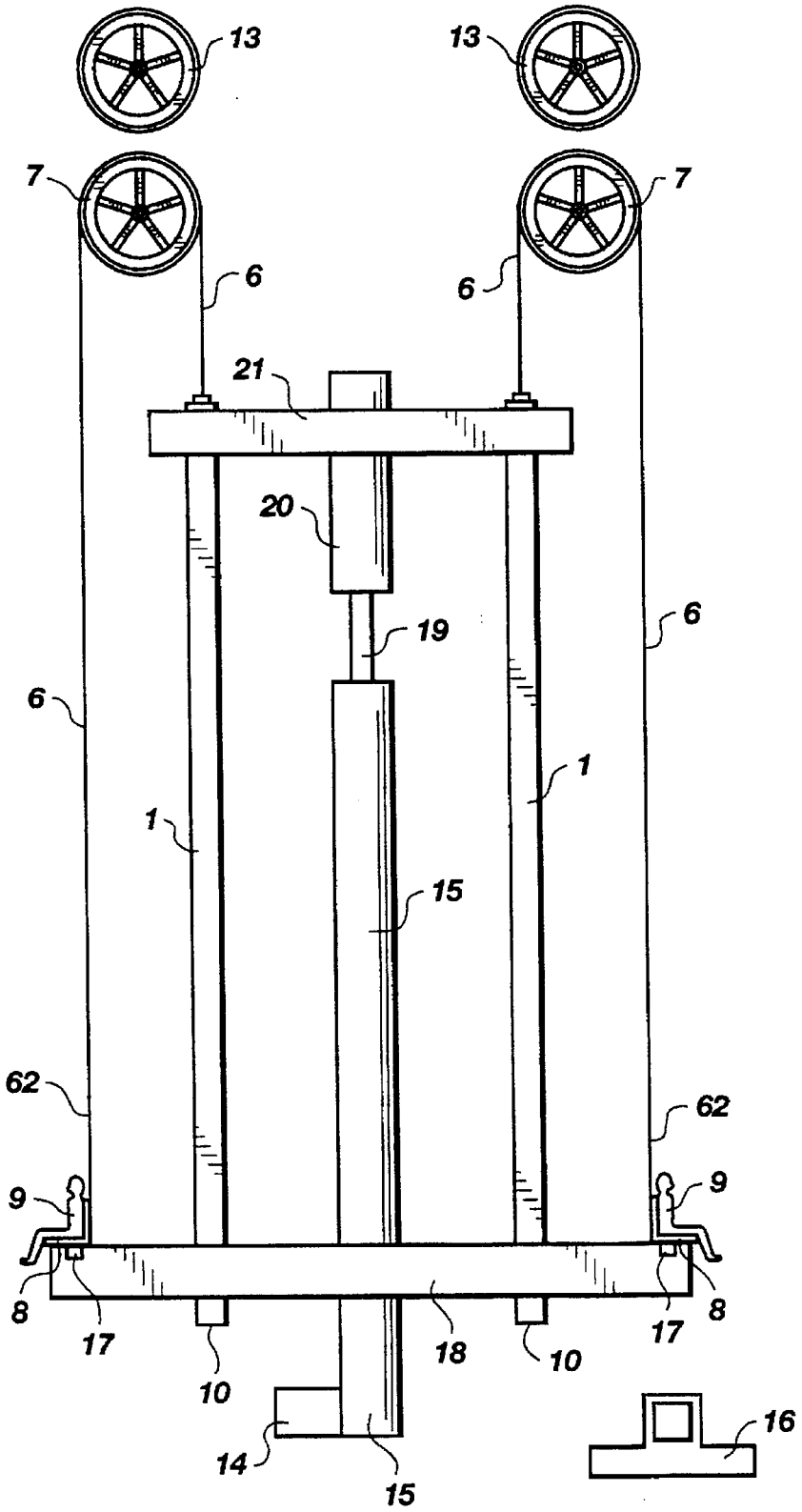
FIG. 3 illustrates an embodiment similar to that of FIG. 2 which demonstrates the capability for using more than one housing to generate the propulsive force and also shows components used to prepare the compressed gas that propels the pistons within the housings to accelerate and decelerate the participants.

FIG. 3 depicts only the features of the Pneumatic Device that are external to the housing (1) but, in doing so, also demonstrates how the compressed gas is prepared and that there can be several housings (1), cables (6), and carriers (8). Each carrier (8) may, furthermore, hold more than one participant (9).

A compressor (14) is connected to a high-pressure tank (15). The compressor (14) compresses gas, preferably air, and stores the resultant compressed gas at a high pressure in the high-pressure tank (15).

A computer (16) communicates with sensors (17) in the platform (18) which supports the carriers (8) when they are at rest. When participants (9) have been seated in a carrier (8), the sensor (17) for the respective carrier (8) determines the weight of that carrier (8) and the participants (9) seated thereon. The sensor (17) then communicates this information to the computer (16).

The high-pressure tank (15) is connected to a selective valve (19), the other side of which selective valve (19) is connected to a propulsive tank (20). (High pressure, as used herein, means that the pressure is equal to or greater than any pressure that will be used in the propulsive tank (20).) The propulsive tank (20) is connected to the injection valve (11) for each housing (1). (This is preferably done within the valve cap (21) and is, consequently, not visible in FIG. 3. The control valve (12) for each housing (1) is also inside the valve cap (21).) Alternatively, instead of employing a separate injection valve (11) for each housing (1), one could utilize a single injection valve (11) which has a single input port for connecting to the propulsive tank (20) and a sufficient number of exhaust ports that a separate exhaust port is available for connecting to each housing (1).

The computer (16) determines and communicates to the selective valve (19) how much compressed gas (air, preferably, as noted above) to allow to enter the propulsive tank (20) in order to propel the participants (9) a desired distance.

Although separate carriers (8) could be operated separately, the carriers (8) are preferably operated simultaneously and are, also, preferably physically connected to one another. Similarly, even though a computer (16) is preferred for controlling how much compressed air is placed in the propulsive tank (20), a mechanical system could perform this task.

Figure 4:
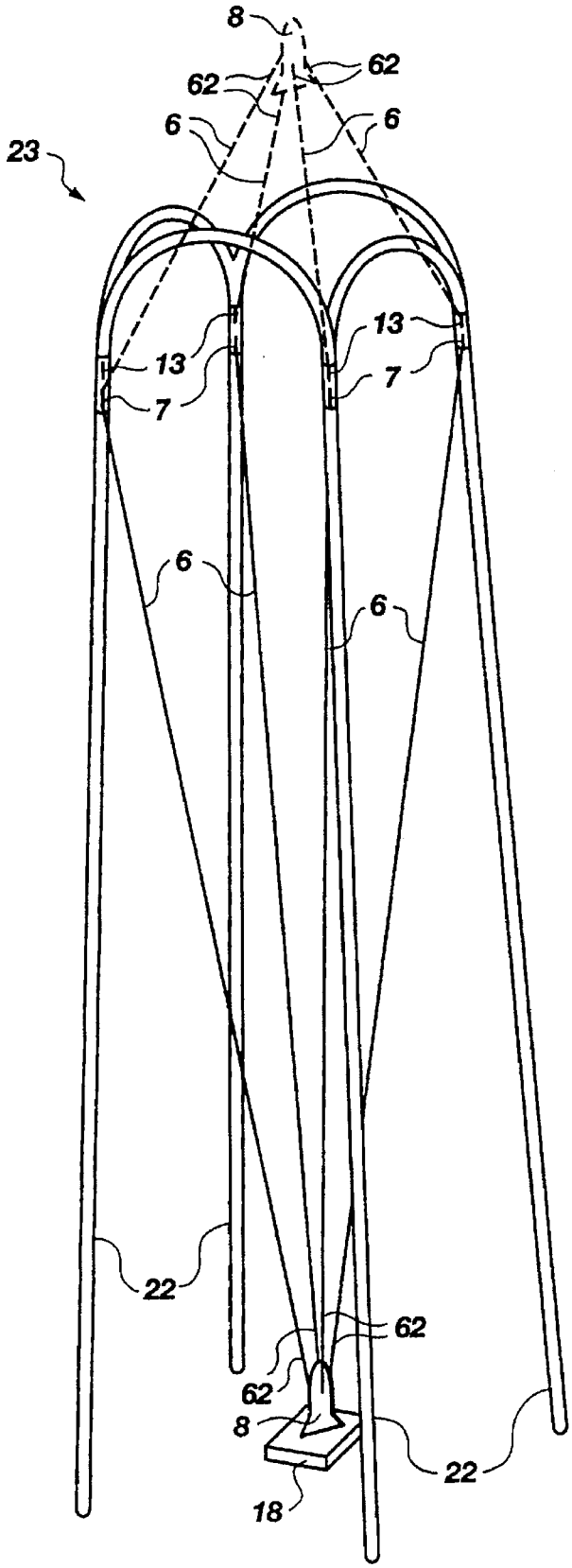
FIG. 4 shows a tower which employs two or more of the embodiments from FIG. 2 to propel a common carrier above the tower, itself.

FIG. 4 portrays a second optional embodiment. There are at least two legs (22) for a tower (generally denoted 23). Each leg (22) contains at least one of the embodiments illustrated in FIG. 2, except that each cable (6) is attached to the common carrier (8). As shown by the dotted lines in FIG. 4, the common carrier (8) can be elevated to a position higher than any portion of the tower (23).

Figure 5:
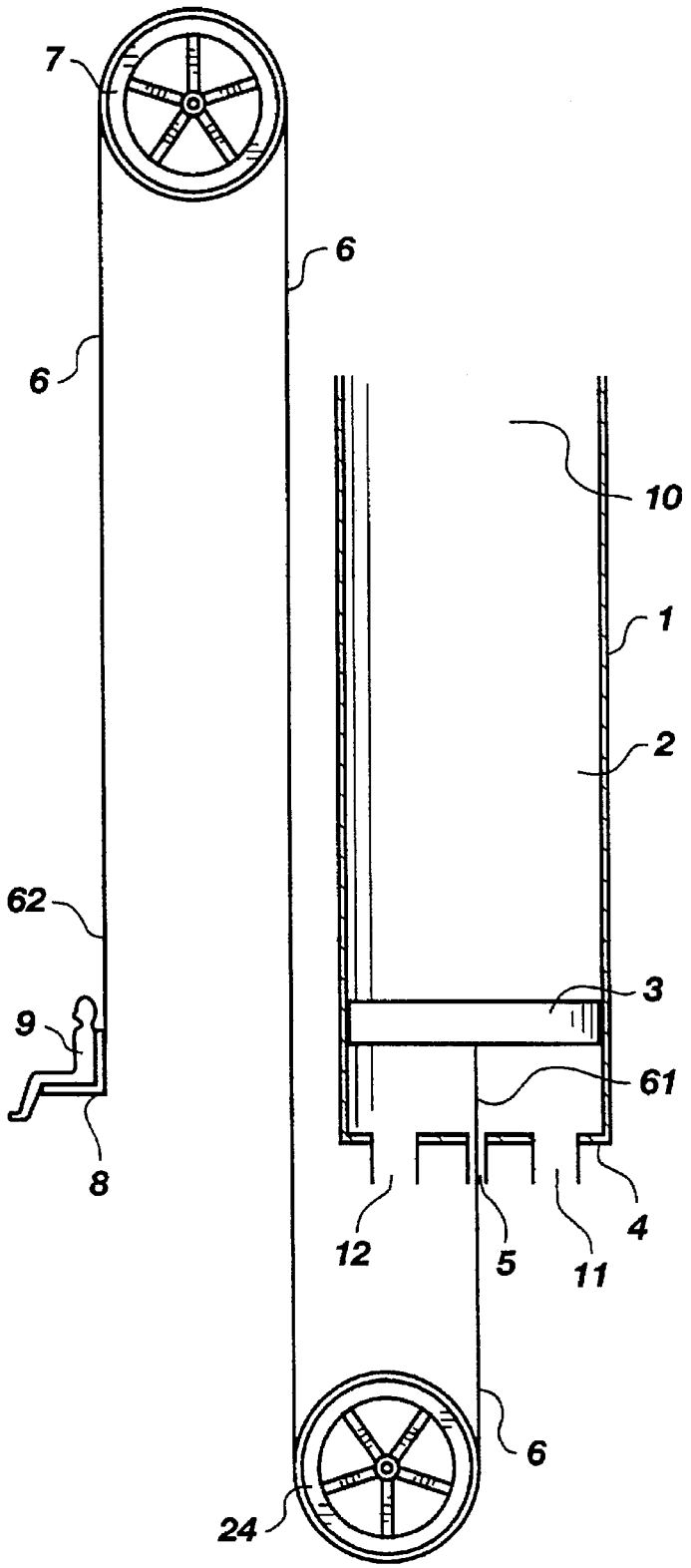
FIG. 5 demonstrates a modification which adds an auxiliary pulley to the embodiment of FIG. 1 so that the piston initially moves in the same direction as the participants.
Figure 6:
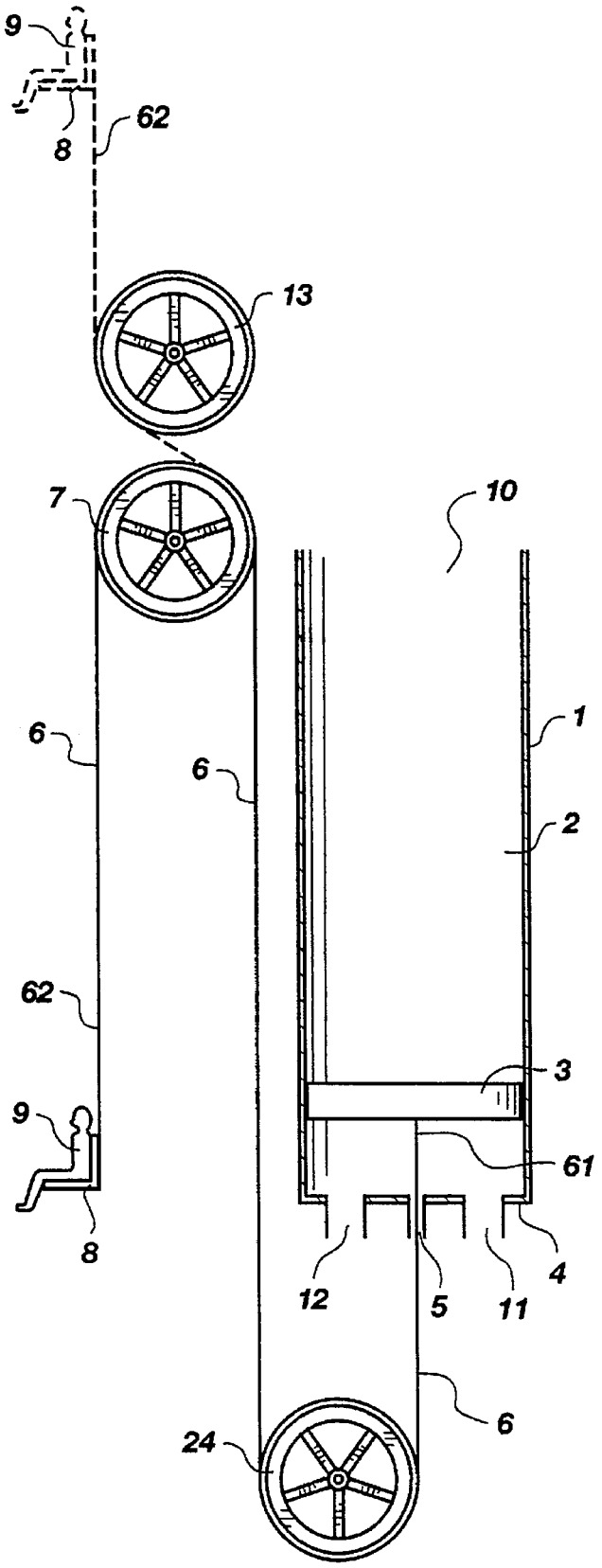
FIG. 6 similarly provides a view of a modification which adds an auxiliary pulley to the embodiment of FIG. 2 in order that the piston will initially move in the same direction as the participants.
Figure 7:
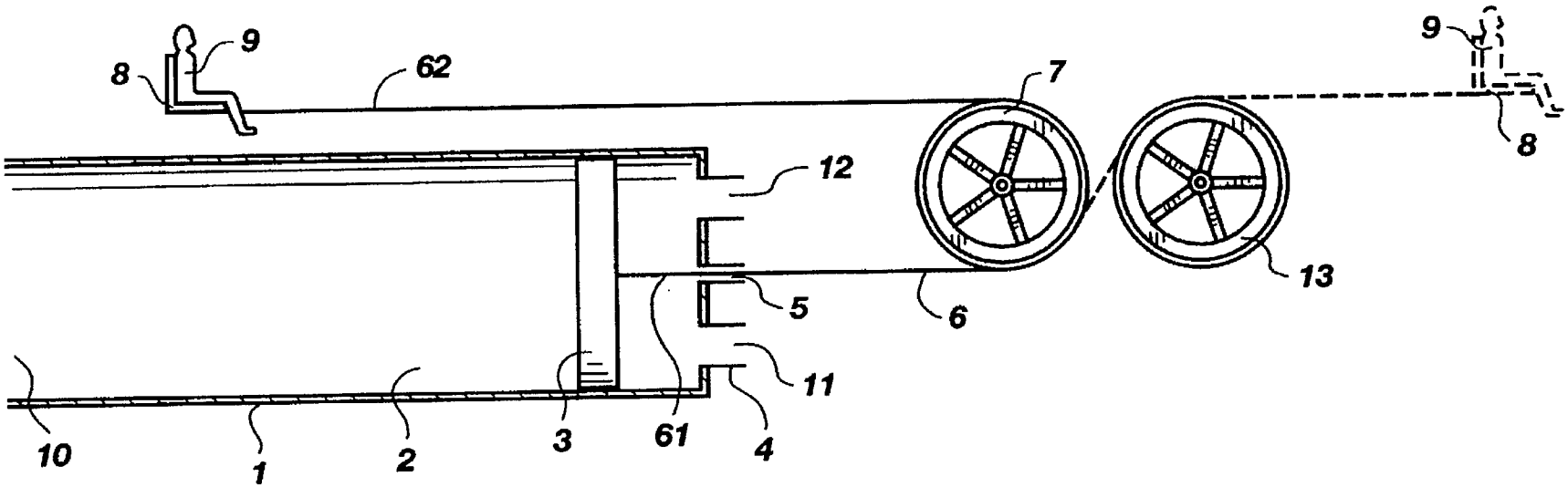
FIG. 7 shows an embodiment where the first guide pulley and the second guide pulley are oriented in a horizontal direction.

If, for any reason, one desires to have the piston (3) initially move in the same direction as the participants (9) do, this can be accomplished simply by adding an auxiliary pulley (24). Such a modification to the embodiment of FIG. 1 is portrayed in FIG. 5; a similar modification to the embodiment of FIG. 2 is shown in FIG. 6.

Although the discussion herein has been directed toward amusement rides, one skilled in the art will readily appreciate that the device which is described herein is equally suitable for rapidly accelerating and decelerating, as well as oscillating, a wide spectrum of objects other than human beings and has obvious applications beyond the field of entertainment.

As used herein the term "object," therefore, includes—but is not restricted to—a human being.

I claim:

1. A pneumatic device for accelerating and decelerating one or more objects, which comprises:

a housing containing a bore, having an aperture near the first end of said housing, and having the second end of said housing open;

a piston slidably mounted within the bore of said housing;

a cable having the first end of said cable attached to said piston, said cable passing through said aperture before having the second end of said cable connected to the object or objects, and said cable being of such length that the piston will never reach the second end of the housing when the second end of said cable has been attached to the object or objects; and an injection valve, located near the first end of said housing, for introducing compressed gas into the bore, which compressed gas expands to accelerate the piston and, consequently, the object or objects and which compressed gas decelerates the piston and, consequently, the object or objects when the piston moves toward the first end of said housing.

2. The pneumatic device for accelerating and decelerating one or more objects as recited in claim 1, further comprising:

a carrier attached to the second end of the cable and available to hold the object or objects.

3. The pneumatic device for accelerating and decelerating one or more objects as recited in claim 1, further comprising:

a first guide pulley over which the cable passes after having exited the housing through the aperture and before said cable reaches the object or objects.

4. The pneumatic device for accelerating and decelerating one or more objects as recited in claim 3, further comprising:

a carrier attached to the second end of the cable and available to hold the object or objects.

5. The pneumatic device for accelerating and decelerating one or more objects as recited in claim 3, further comprising;

a second guide pulley which is aligned with the first guide pulley and located on the side of said first guide pulley opposite to the initial location of the object or objects to be accelerated so that when said object or objects pass said first guide pulley toward said second guide pulley, the cable will leave the first guide pulley and engage the second guide pulley.

6. The pneumatic device for accelerating and decelerating one or more objects as recited in claim 5, further comprising:

a carrier attached to the second end of the cable and available to hold the object or objects.

7. The pneumatic device for accelerating and decelerating one or more objects as recited in claim 1, further comprising:

a control valve connected to the housing to release compressed gas and terminate or reduce the acceleration and deceleration.

8. The pneumatic device for accelerating and decelerating one or more objects as recited in claim 7, further comprising:

a carrier attached to the second end of the cable and available to hold the object or objects.

9. The pneumatic device for accelerating and decelerating one or more objects as recited in claim 7, further comprising:

a first guide pulley over which the cable passes after having exited the housing through the aperture and before said cable reaches the object or objects.

10. The pneumatic device for accelerating and decelerating one or more objects as recited in claim 9, further comprising:

a carrier attached to the second end of the cable and available to hold the object or objects.

11. The pneumatic device for accelerating and decelerating one or more objects as recited in claim 9, further comprising:

a second guide pulley which is aligned with the first guide pulley and located on the side of said first guide pulley opposite to the initial location of the object or objects to be accelerated so that when said object or objects pass said first guide pulley toward said second guide pulley, the cable will leave the first guide pulley and engage the second guide pulley.

12. The pneumatic device for accelerating and decelerating one or more objects as recited in claim 11, further comprising:

a carrier attached to the second end of the cable and available to hold the object or objects.

13. The pneumatic device for accelerating and decelerating one or more objects as recited in claim 1, further comprising:

a propulsive tank for storing the compressed gas, which propulsive tank is connected to the injection valve.

14. The pneumatic device for accelerating and decelerating one or more objects as recited in claim 13, further comprising:

a carrier attached to the second end of the cable and available to hold the object or objects.

15. The pneumatic device for accelerating and decelerating one or more objects as recited in claim 13, further comprising:

a first guide pulley over which the cable passes after having exited the housing through the aperture and before said cable reaches the object or objects.

16. The pneumatic device for accelerating and decelerating one or more objects as recited in claim 15, further comprising:

a carrier attached to the second end of the cable and available to hold the object or objects.

17. The pneumatic device for accelerating and decelerating one or more objects as recited in claim 15, further comprising:

a second guide pulley which is aligned with the first guide pulley and located on the side of said first guide pulley opposite to the initial location of the object or objects to be accelerated so that when said object or objects pass said first guide pulley toward said second guide pulley, the cable will leave the first guide pulley and engage the second guide pulley.

18. The pneumatic device for accelerating and decelerating one or more objects as recited in claim 17, further comprising:

a carrier attached to the second end of the cable and available to hold the object or objects.

19. The pneumatic device for accelerating and decelerating one or more objects as recited in claim 13, further comprising:

a control valve connected to the housing to release compressed gas and terminate or reduce the acceleration and deceleration.

20. The pneumatic device for accelerating and decelerating one or more objects as recited in claim 19, further comprising:

a carrier attached to the second end of the cable and available to hold the object or objects.

21. The pneumatic device for accelerating and decelerating one or more objects as recited in claim 19, further comprising:

a first guide pulley over which the cable passes after having exited the housing through the aperture and before said cable reaches the object or objects.

22. The pneumatic device for accelerating and decelerating one or more objects as recited in claim 21, further comprising:

a carrier attached to the second end of the cable and available to hold the object or objects.

23. The pneumatic device for accelerating and decelerating one or more objects as recited in claim 21, further comprising:

a second guide pulley which is aligned with the first guide pulley and located on the side of said first guide pulley opposite to the initial location of the object or objects to be accelerated so that when said object or objects pass said first guide pulley toward said second guide pulley, the cable will leave the first guide pulley and engage the second guide pulley.

24. The pneumatic device for accelerating and decelerating one or more objects as recited in claim 23, further comprising:

a carrier attached to the second end of the cable and available to hold the object or objects.

25. A pneumatic device for accelerating and decelerating one or more objects, which comprises:

a housing containing a bore, having an aperture near the first end of said housing, and having the second end of said housing open;

a piston slidably mounted within the bore of said housing;

a carrier available to hold the object or objects;

a cable having the first end of said cable attached to said piston, said cable passing through said aperture before having the second end of said cable attached to said carrier, and said cable being of such length that the piston will never reach the second end of the housing;

an injection valve, located near the first end of said housing, for introducing compressed gas into the bore, which compressed gas expands to accelerate the piston and, consequently, the object or objects and which compressed gas decelerates the piston and, consequently, the object or objects when the piston moves toward the first end of said housing;

a first guide pulley over which the cable passes after having exited the housing through the aperture and before said cable reaches said carrier;

a second guide pulley which is aligned with the first guide pulley and located on the side of said first guide pulley opposite to the initial location of the object or objects to be accelerated so that when said object or objects pass said first guide pulley toward said second guide pulley, the cable will leave the first guide pulley and engage the second guide pulley;

a control valve connected to the housing to release compressed gas and terminate or reduce the acceleration and deceleration;

a propulsive tank for storing the compressed gas, which propulsive tank is connected to the injection valve;

a selective valve, the first end of which selective valve is attached to the propulsive tank to provide a predetermined quantity of compressed gas to the propulsive tank;

a high-pressure tank connected to the second end of the selective valve, which high-pressure tank stores the compressed gas; and a compressor connected to the high-pressure tank, which compressor compresses gas and transfers such compressed gas to the high-pressure tank.

26. The pneumatic device for accelerating and decelerating one or more objects as recited in claim 25, further comprising:

a sensor located beneath the resting carrier that measures the weight of the carrier and object or objects; and a computer that receives the measurement of weight from the sensor and then determines and communicates to the selective valve the quantity of compressed gas to be allowed to enter the propulsive tank in order to propel the object or objects a desired distance.

* * * * *